US008210512B2

(12) United States Patent
McFarland et al.

(10) Patent No.: US 8,210,512 B2
(45) Date of Patent: Jul. 3, 2012

(54) ARRANGEMENT FOR THE TIMED PROCESSING OF A PRINTED PRODUCT WITH THE AID OF A TRANSFER DEVICE

(75) Inventors: Robert W. McFarland, Newport News, VA (US); Guenther Silberbauer, Uerkheim (CH)

(73) Assignee: Mueller Martini Holding AG, Hergiswil (CH)

( * ) Notice: Subject to any disclaimer, the term of this patent is extended or adjusted under 35 U.S.C. 154(b) by 98 days.

(21) Appl. No.: 12/553,321

(22) Filed: Sep. 3, 2009

(65) Prior Publication Data

US 2011/0054672 A1 Mar. 3, 2011

(51) Int. Cl.
*B65H 39/02* (2006.01)

(52) U.S. Cl. ..... 270/52.14; 270/58.07; 270/52.18; 412/10; 412/11; 412/12

(58) Field of Classification Search ..... 270/52.14, 270/52.18, 58.07; 412/10, 11, 12
See application file for complete search history.

(56) References Cited

U.S. PATENT DOCUMENTS

| | | | | |
|---|---|---|---|---|
| 4,157,821 | A * | 6/1979 | Fabrig | 270/58.07 |
| 5,522,588 | A * | 6/1996 | Soltysiak | 270/58.07 |
| 6,966,553 | B2 * | 11/2005 | Rathert | 270/52.18 |
| 7,410,157 | B2 * | 8/2008 | Stolz | 270/52.14 |
| 2006/0076725 | A1 * | 4/2006 | Matalevich et al. | 270/58.08 |

FOREIGN PATENT DOCUMENTS

EP 1 645 434 A1 4/2006

* cited by examiner

*Primary Examiner* — Patrick Mackey
(74) *Attorney, Agent, or Firm* — Venable LLP; Robert Kinberg; Leigh D. Thelen

(57) ABSTRACT

With an arrangement for the timed processing of a book block, consisting of at least one printed sheet or at least one signature, a transfer device is arranged in-between the feed devices for the book blocks and the device for the further conveying of such a book block, wherein this transfer device supplies the book blocks to at least one other processing station. The transfer device is provided with a translation device for taking over or clamping in the book block, wherein this translation device executes at least one rotary or quasi-rotary translation movement. The translation device itself operates in at least two spatial dimensions for the transfer of the book block, wherein the translation movement occurs with a uniform or a changeable movement speed. The center axis for the translation device occupies an optional position in space, relative to the further processing station.

30 Claims, 11 Drawing Sheets

ARRANGEMENT FOR THE TIMED PROCESSING OF A PRINTED PRODUCT WITH THE AID OF A TRANSFER DEVICE

BACKGROUND

The European patent document EP 1 645 434 A1 discloses an arrangement for the timed processing of book blocks, composed of printed sheets, wherein these are frequently composed either of individual sheets or folded signatures. The aforementioned publication proposes assigning a lifting device provided with end stop to the feed element. With the aid of the lifting device, a supplied book block is pivoted from a horizontal position to a vertical position and is then transferred with the help of an adjustably driven end stop to the clamp of the perfect binder. With this sequence of operational steps, book blocks supplied while positioned horizontal can be transferred without problem and avoiding additional changeover movements to a perfect binding station. In the process, the book block is placed into the upright position by the lifting device and is inserted from below into a perfect binder clamp. The lifting movement is initiated before a book block arrives at the end stop, wherein the adjustability of the end stop can also be utilized for adjusting the format of the supplied book block. However, it has turned out that with such an operating sequence, the cycle time or the cadence is subject to relatively strong limitations. As a result, it is no longer possible to achieve higher timing rates because the underlying sequence is configured such that a return lift is first required before a new book block is advanced, meaning before it can be taken over.

In principle it has turned out that a book block can be supplied along an advancing plane only over the course of a plurality of processing cycles for which a longer feed section is required.

Several solutions are already disclosed for correcting this problem. However, these solutions on the whole did not satisfy since a partial improvement in each case could be achieved only with additional structural measures, which in turn had a negative effect on the susceptibility of the system.

For example, it was necessary to assign a guide element that is positioned at a distance to the guide rails forming the guide plane in order to prevent the possible tilting to one side of the book block at the end stop. This guide element supports and guides the book block on the opposite side.

To be sure, the book blocks can be pivoted with the aid of a gear assembly that is drive-connected to the end stop from the horizontal position on the feed element to a vertical position in which it rests on the book block spine, but this can be done only if corresponding additional guide rails are provided.

To prevent a tilting, the different book block thicknesses furthermore require an adjustment of the distance between the guide plane formed with the guide rails and the guide element. Unfortunately, this can be achieved with respect to kinematics only if a traction mechanism is provided.

It must furthermore be considered that at the instant of feeding the book block, meaning when the aforementioned lifting device is in the starting position, the guide rails must advantageously be positioned below the conveying center of the conveying elements, which are supported gliding on supports, to avoid friction between the book blocks and the guide rails, wherein this requires additional measures.

As a result of these point-by-point considerations, we can state that all the modifications disclosed so far involve a relatively large expenditure and have not always yielded the initially expected results, so that we now feel pressured to take new paths and provide new suggestions for developing an arrangement for the timed processing of book blocks composed of at least one printed sheet. It may be taken into consideration here that the book blocks may be composed of loose sheets, meaning the printed sheets are not securely joined to each other. Of course, it is also possible to use book blocks where the printed sheets are joined ahead of time.

SUMMARY

It is an object of the present invention to correct the disadvantages of the prior art and to show advantageous new paths. The above an other objects are accomplished according to one aspect of the invention wherein there is provided an arrangement for the timed processing of book blocks, composed of at least one printed sheet or at least one signature, which, in one embodiment, includes at least one book block feed device; at least one processing station; and at least one transfer device, coupled to the at least one book block feed device to further convey the book blocks from the at least one transfer device to the at least one processing station, wherein the transfer device comprises at least one rotary or quasi-rotary translation device to take over the book blocks, wherein the at least one translation device operates in at least two dimensions to further convey the book blocks, wherein the at least one translation device has a uniform or changeable movement speed, and wherein the center axis of the at least one translation device occupies an optional position in space, relative to the at least one processing station.

One embodiment includes a system along with the necessary technical infrastructure, for which the critical speeds of the feeding method can be regular or irregular, can involve an acceleration or delay, can behave either synchronous or asynchronous, and can have adaptive accelerations or delays. The final purpose of the measures according to the embodiment may therefore be seen as a maximizing of the timing rates along with a careful handling of the print medium.

It is furthermore an object of the invention to propose measures for removing the individual book blocks as quickly as possible from the book block feed device, for example, by using a transfer device, which securely creates a space for the subsequently arriving book block. This has a positive effect on the cycle times and also allows maximizing the output.

A further object is to ensure a careful transfer of the book blocks along the conveying path, for example from the book block feed device to the transfer device and from there to the book channel.

The book blocks may be generated with the aid of a digital printing press, where such a digital printing press allows the sequential printing of the pages for a book block or a book. The sequential printing of a book block means that the digital printing press may start with the printing of the first sheet, which is followed sequentially and immediately by the printing of the other sheets for completing the book or the book block. Digital printing presses may operate without a fixed printing form and can therefore operate in the above-presented manner. Following the printing operation, the successively printed sheets can then either be stacked to form a book block, or they can be folded with the aid of a suitable folding machine into signatures and then stacked to form book blocks.

The book blocks to be transferred may be loose stacks composed of individual printed sheets or folded signatures. However, they can also be secured for the transport so that the individual printed sheets or the signatures cannot slide relative to each other. This can also be understood to mean a fixation in-between the layers with respect to the stacked printed sheets or signatures, or a temporary fixation, and that this fixation does not have a system-relevant effect in the completely processed and finished printed product or the product which is processed further. As a result, the compactness of the book block can be ensured during the transport.

With respect to the transfer device, an object of the normal or adaptive acceleration or delay is to influence the translational speeds of the transfer device within implemented movement profiles. The movement profiles can include various curve functions, as well as dwell times or stop times. In principle, an object may be to allow the movement speed to follow a specific progressive-movement profile, which is composed of one or more separate curve functions, or of curve functions that are superimposed relative to each other, in connection with the transfer process as well as in view of the otherwise relevant speeds within the arrangement, in particular also in view of the movement speeds of the book block feed device and the book channel.

According to one embodiment, the book block is not supplied and inserted directly into the clamp, but is transferred to an upstream-arranged book channel. A book channel of this type is disclosed in the art and may be used, for example, in connection with a gathering machine. A book channel of this type is known from gathering machines as a gathering channel that can be used to convey signatures, bound books and loose or secured book blocks with the aid of gripper fingers or other auxiliary mechanisms inside the channel.

According to another embodiment, the arrangement distances itself from a device moving in a purely linear or quasi-linear direction for supplying the book blocks from one station to the next station and that it proposes supplying the book blocks with the aid of a rotary or quasi-rotary translation movement to the book channel before they are conveyed further to a processing station. As a result, it may be possible to sustainably increase the timing or throughput rates while, at the same time, permitting a careful handling of the loose book blocks.

For the present case, the term translation refers to a movement where all points of the moving body are moving in the same direction.

The term quasi-rotary translation is in principle is understood to mean a movement for conveying the book block along a curved path. However, at least one linear movement can also be superimposed on the curved movement in one axis, or it can expand or superimpose the rotary movement at an optional location, wherein a movement of this type can also be generated by an outside mechanism, for example a robot-type arm. Accordingly, it is not absolutely required to implement the linear movement sequence before or after the rotary movement, but it can also be implemented in-between. Such combinations are always useful at locations where the space conditions or already existing units restrict the clearance spaces. It is furthermore advantageous that this linear movement can occur in a horizontal, vertical or also slanted position, which additionally ensures a high flexibility for the arrangement according to the invention.

According to another embodiment, during the transfer operation, the rotary or, if applicable, the quasi-rotary translation movement is not necessarily restricted to a two-dimensional movement. Rather, during the feeding operation, the aforementioned translation movements can also easily occupy the third dimension, if necessary, in view of the fact that at least during the complete transfer process the layers of the individual folded sheets must optimally be handled so that they cannot slide relative to each other, for example, meaning such that they can retain their compact shape during the complete process. Relative to the feed plane leading to the book channel, the rotary or quasi-rotary translations can assume any position per se, meaning, for example, horizontal or vertical or angled, where intermediate combinations are possible as well.

According to a further embodiment, the system is configured to allow a continuous as well as an intermittent feeding of the book blocks, which in turn expands or widens the applicability and flexibility of the system. This may be necessary, for example, if measuring/control stations are provided in the processing flow, which trigger interventions based on quality considerations without this having a negative effect on the product-related flow cadence. However, that is not always the case in particular for a conventional linear feed where quality-indicated interventions for the most part have a negative effect on the product-related cadence.

According to one embodiment, the system may include structural measures for which the geometry is selected such that it is in principle unnecessary to adjust the feed devices to the respective book block format. In turn, this has the advantage that even the smallest batches can be processed without requiring major conversions.

As mentioned above, the system according to the various embodiments for the first time may make it possible to achieve the type of comprehensive quality, which until now could not be achieved consequently with the prior art systems, which frequently was the result of a compromise because it would excessively lower the throughput rates.

Since the system according to the invention is flexible, as compared to a strictly timing-related, continuous feeding of the book blocks to the transfer device for the transfer process, it may be possible without problem to provide measuring/control stations prior to the rotary movement, which are adjusted to narrow tolerances and, upon exceeding a specific tolerance limit, are activated and in turn activate corresponding transfer-out mechanisms. The dimensional controls in this case relate in particular to the book block format and may be directed toward the height, width and thickness of the respective book block. In addition, they also comprise an identifying feature for the book block.

According to one embodiment, the measuring/control stations can also forward the measuring data to the following processing station, for example for the precise adjustments of the following processing machines. As a result, the measuring/control stations not only take on a purely static control function for an actual condition, but they also forward production-relevant information to the down-stream arranged processing machines.

According to another embodiment, the rotary as well as the quasi-rotary translation movements can be accelerated or delayed either in a uniform or non-uniform manner, wherein we point to the above explanations for the effects of such a speed change.

According to a further embodiment, the book blocks moving along the feed section can be positioned either transverse or in longitudinal direction, without this negatively affecting the timing rates. For example, optimally adjusting the position of the book block in front of the perfect binder does not influence the timing rate predetermined by the translation. This high flexibility is caused by the wide range of embodiment options for the translation devices used in the area of the transfer device, meaning the movement sequence of the translation can control the transfer of the book block to the book channel such that the following processes, e.g. the application of the binder, can occur under continuous optimum processing conditions.

Emphasized herein is the fact that the different options for configuring the transfer devices used all have a congruent finality and accordingly are all subject matters representing a uniform inventive idea.

Owing to the high flexibility of the rotary translation, it is also possible to provide additional control mechanisms along the path to the transfer station, which can monitor the quality, wherein these can be focused onto the position and inner consistency of the book blocks.

According to one embodiment, the takeover element belonging to the transfer device, for example taking the shape of a fork-type structure, takes over the advancing of the book blocks during the translation and is subjected to a angular movement immediately before the transfer, which forces the book block to assume a slanted position in the takeover element, so that the book block can purposely slide toward the end stop within this takeover element. A slanted positioning of this type among other things has a stabilizing effect on the book blocks mass, wherein this effect is accompanied by an increase in the ability of the body to stay put. However, the slanted position can also exist from the start and does not necessarily have to be imposed during the process at a suitable location, meaning specifically during the course of the rotary or quasi-rotary movement.

One advantage of the invention as it relates to the system includes the fact that it also has advantages for the peripheral systems, which are responsible for the product flows. As a result, printed products from a plurality of product flows or from divided product flows can be advanced, meaning a plurality of feeding stations can converge toward the rotary or quasi-rotary translation of the operating transfer device, so that parallel-operated transfer devices can also be provided as needed. This has the effect of an increase in the production, which is causally connected to an increased productivity of the arrangement according to the invention.

BRIEF DESCRIPTION OF THE DRAWINGS

The present invention will be more readily understood from the following detailed description when read in conjunction with the following drawings, in which.

DETAILED DESCRIPTION

Figure 1:
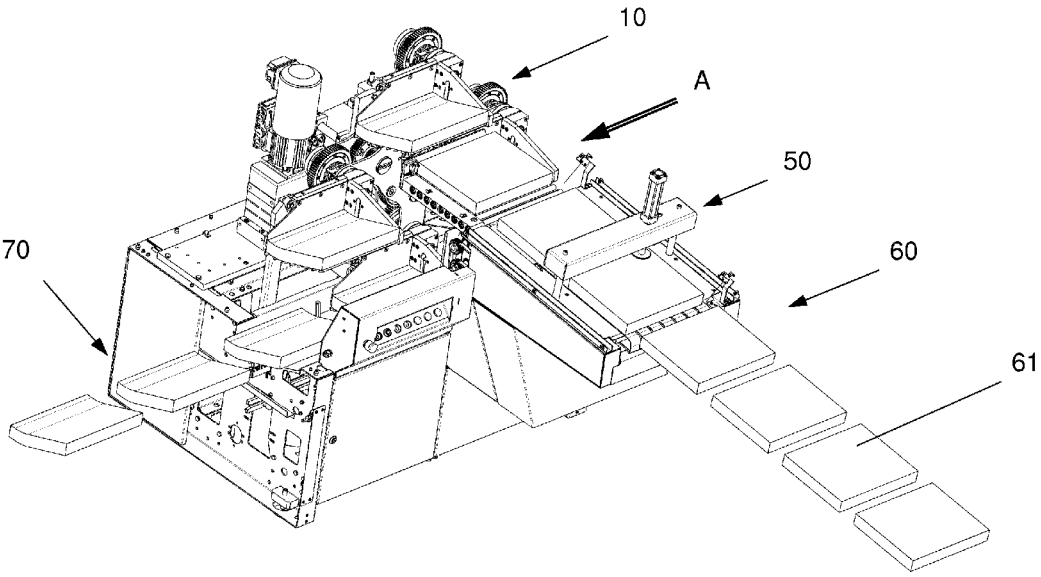
FIG. 1 depicts a device for feeding book blocks to a rotary-driven transfer device, including a measuring/control station, according to an embodiment of the invention.
Figure 7:
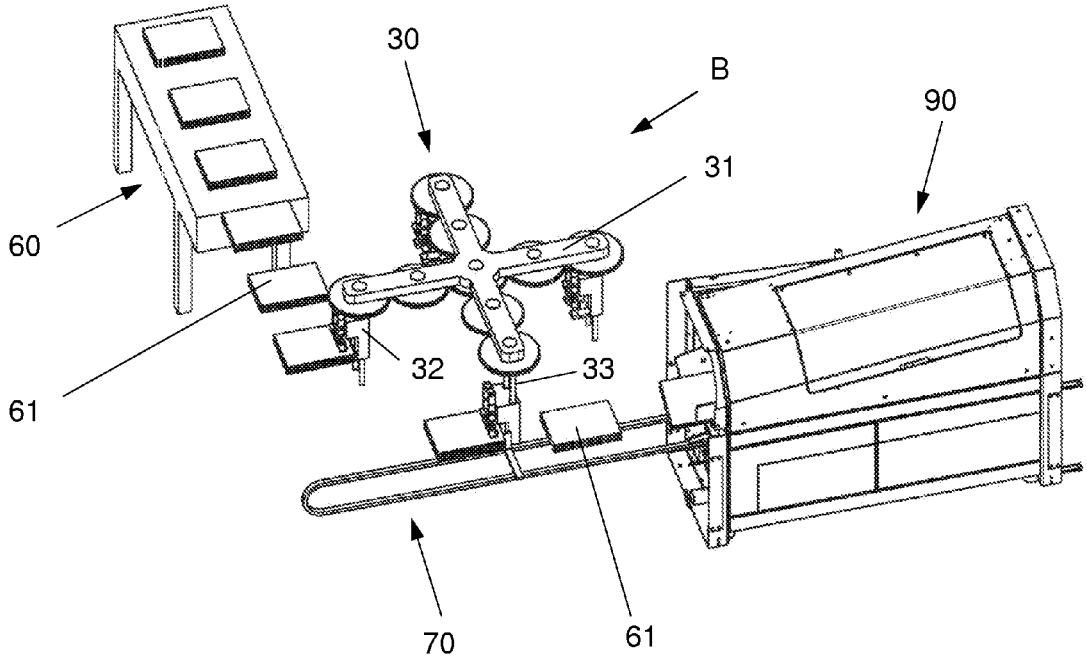
FIG. 7 depicts a different rotary-driven transfer device, having transport arms that are effective perpendicular to the book channels, whereas the transfer device itself rotates in the manner of a carrousel, according to an embodiment of the invention.

FIG. 1 shows an arrangement A that essentially consists of a feed device 60 for book blocks 61, an in-between arranged control unit 50, a transfer device 10, and a conveying section 70 for conveying the book blocks to a processing station that is not shown in further detail herein (see FIG. 7).

To ensure uniformity for the terms used herein, the feed device 60 is henceforth called a "book block feed device" and the conveying section 70 for conveying the book blocks downstream of the transfer device is referred to as "book channel."

This Figure only shows the basic components of an arrangement A of this type, wherein the individual components are shown and described in further detail in the following Figures. Thus, the transfer device 10 is shown and described in more detail in FIGS. 3-6 while the control station 50 is described in further detail with the explanations provided for FIG. 11.

Figure 2:
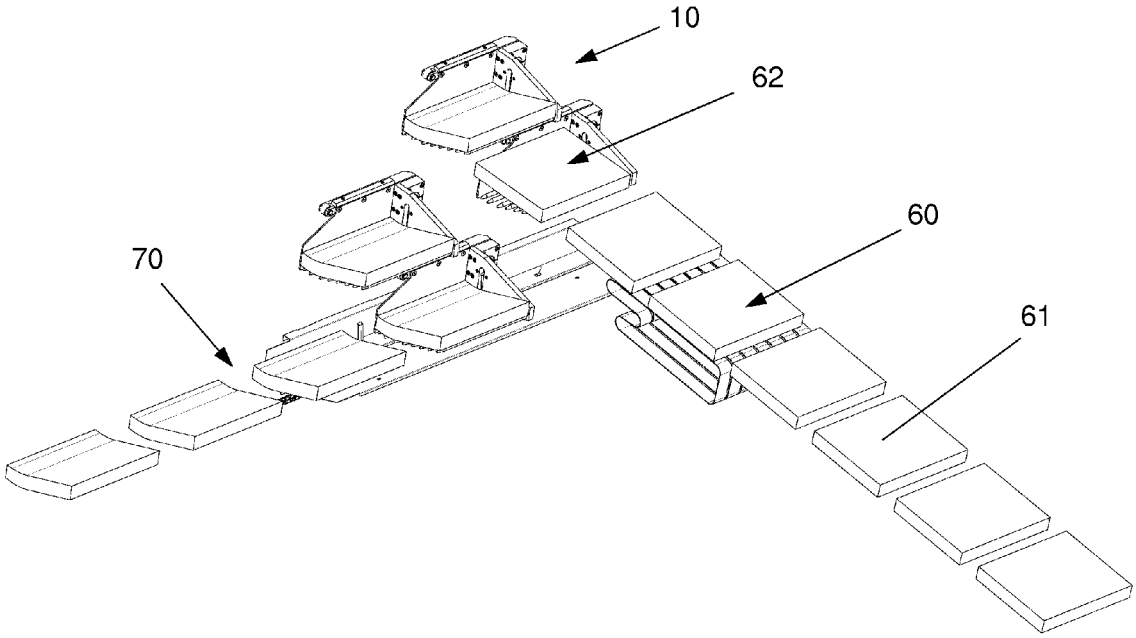
FIG. 2 depicts a stylized representation of the feed device shown in FIG. 1.

FIG. 2 contains a stylized representation of FIG. 1 and is only intended to show the main components of the arrangement A, namely the transfer device 10, the book block feed device 60, and the book channel 70. Particularly easy to see in this Figure is the completed takeover 62 of a book block 61 by a component of the transfer device 10.

Figure 3:
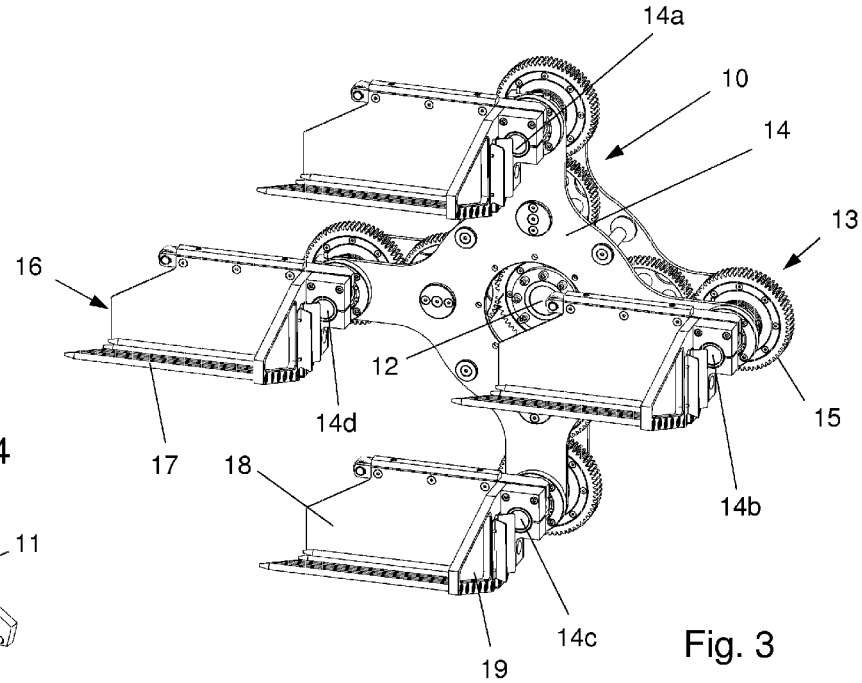
FIG. 3 depicts a complete drive assembly for the rotary-driven transfer device, according to an embodiment of the invention.

FIG. 3 shows details of the design for the previously mentioned transfer device 10, which forms the central component, between the feed device 60 for the book blocks 61 and the book channel 70 which connects to the further processing stations.

The transfer device 10 shown here in FIG. 3 carries out a purely circular movement in a plane, starting with a rotating main center axis 12. This main center axis 12 is operatively connected to a planet gear 13, which is known per se and which drives with the aid of a circular movement a square, star-shaped rotor 14, wherein the four corner points of this rotor 14 carry respectively one shaft 14*a*-14*d* that is operatively connected to a peripheral gearwheel 15 of the planet gear 13. These shafts form the respective starting points for holding a takeover element 16, which in turn is embodied in the manner of a console having a fork-type support plane 17 which forms the support surface for the further transport of the book blocks 61, wherein this support plane 17 may be designed to accommodate a single book block 61. During the rotational movement of the rotor 14, each takeover element 16 together with the support plane 17 assumes initially a preferably quasi-horizontal position over most of its peripheral movement. It means that the support planes 17 are not positioned strictly horizontal, but are already positioned at a slight inclination that coincides with the inclination of the book channel 70. However, the support planes 17 per se can also occupy a position that is parallel to the book block feed device or horizontal thereto.

The respectively assumed position is directly connected to the optimum takeover and subsequent transfer of the book blocks 61, meaning to the sequence of operations for the book block feed device 60 as well as the book channel 70. The goal here is to push the book blocks supplied by the book block feed device 60 carefully onto the support plane 17 and to transfer these book blocks carefully from the support plane to the book channel 70.

The support planes 17 at first maintain the initially assumed horizontal or quasi-horizontal position. Seen this way, the circular rotating takeover elements 16 follow a movement sequence that resembles the course of a giant wheel equipped with freely suspended cabins.

The book blocks 61 are conveyed further while positioned on the support plane 17 and, in the final phase of a cycle, are transferred to the book channel 70. As previously mentioned, this transfer should take place with the utmost care, which represents an essential aspect of ensuring the quality. For that purpose, the dynamic for this transfer can be configured such that the support plane 17 initially occupies an intermediate position above the book channel 70 and, starting from this intermediate position, initiates an acceleration in the direction of the book channel 70, such that it subsequently approaches the book channel 70 in the end phase of the operation with decreasing, adapted speed and in a quasi-asymptotic manner, thereby ensuring that the conditions for the maximum careful transfer of the book block 61 are met. An acceleration of this type can be realized in a careful manner if a gripper finger located in the intermediate plane is accelerated and moves the book block into the book channel 70, wherein the relative speed differences must be kept low during the transfer of the product to the book channel.

The support plane 17 is delimited by two adjacent walls 18, 19, which may be positioned at approximately a right angle to each other. This right-angle positioning corresponds to the peripheral geometry of the book block 61, wherein the corner formed by the adjacent walls 18, 19 forms an optimum end stop for the book block 61, as will be discussed in further detail later on.

Figure 4:
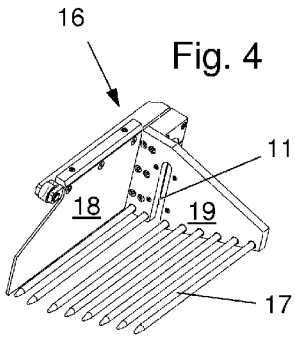
FIG. 4 depicts a more detailed look at a takeover element, showing the slot guidance for the gripper finger, according to an embodiment of the invention.

FIG. 4 shows the configuration of a single takeover element 16. This element is provided in the region of the wall 19 with a slot 11, having a width that continues over the complete support plane 17. A gripper finger (see FIGS. 5 and 6) is operatively connected to this slot 11, such that it permits a careful pushing of the book block 61 from the aforementioned support plane 17 into the book channel 70, which is not shown in further detail herein.

Figure 5:
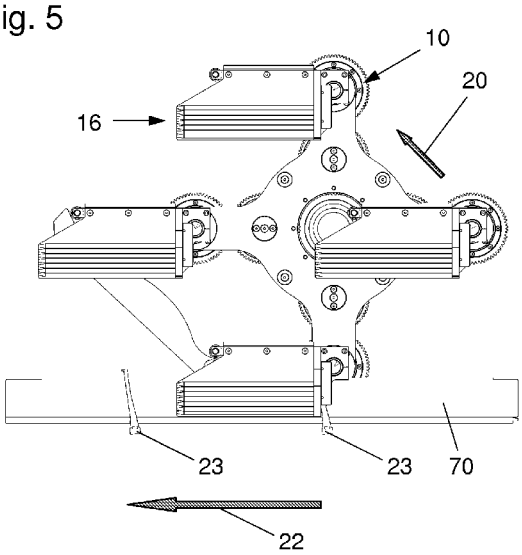
FIG. 5 depicts a transfer device at a specific circulation position, in which the takeover elements are located at the poles, according to an embodiment of the invention.

FIG. 5 shows a simplified representation of the transfer device 10 according to FIG. 3 with the takeover elements 16 positioned at the poles. It is again easy to see that the support plane 17 of each takeover element 16 occupies a quasi-horizontal position, which is also obvious from the drawing. The drawing furthermore shows that the takeover elements 16 rotate in counter-clockwise direction 20 and are operatively connected to a book channel 70, arranged below, for which the movement direction 22 is counter to the rotational direction 20 of the transfer device 10. Fixedly mounted and uniformly spaced-apart gripper fingers 23 are effective in movement direction of the book channel 70 and carefully push the respective book block from the support plane 17 on the takeover element 16 onto the book channel 70, directly positioned underneath. For this purpose, the takeover element 16 is provided with a continuous slot 11, extending parallel to the movement direction of the book channel 70 (see FIG. 4), wherein this slot is adapted to the thickness of the gripper finger 23 and can be seen particularly well in FIG. 4.

Figure 6:
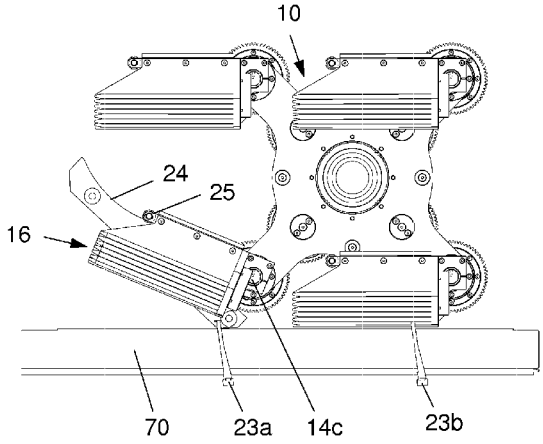
FIG. 6 depicts a transfer device at a specific circulation position in which one of the transfer forks is operatively connected to a link mechanism, according to an embodiment of the invention.

The assumed horizontal position of the individual support planes 17, relative to the book channel 70 underneath, experiences a time-related position change during each rotation, which is started by a link mechanism 24 that grips the respective takeover element 16 just before it reaches the lowest position on the book channel side and imposes on the takeover element 16, rotating past it at this location, a partial angle-changing movement around the shaft 14*c*, as shown in FIG. 6. A roller 25 that is connected to the takeover element 16 ensures that the complete distance of the link mechanism 24 is traced. The position change relative to the support plane 17 can therefore also be triggered by a complementary drive element, for example a motor or a cam gear.

Owing to the fact that the takeover element 16 in the described region changes its former position relative to the book channel 70 creates more space, so that the gripper finger 23*a* passing by immediately underneath does not collide with the arriving takeover element 16, meaning it cannot hit the support plane 17 (see FIGS. 3 and 4). The support plane 17 resumes its original horizontal or quasi-horizontal position only after completing the angle movement predetermined by the link mechanism, which directly coincides with the point in time in which the following gripper finger 23*b* is used for pushing the book block 61, positioned on the support plane 17, onto the book channel 70 to be conveyed to the further processing station. A strict, timing-related interdependence must exist between the existing angle speed of the rotary translation, meaning the cadence of the individual takeover element 16, and the interval-related use of each gripper finger 23*a*, 23*b*.

The link mechanism 24 can furthermore be designed such that the respective takeover element 16 can execute a movement to occupy a slanted or more slanted position in addition to the angle movement, thus forming a diagonal to the corner formed with the adjacent walls 18, 19 so that the book block 61 can if need be slide toward the right-angle corner formed by the two walls 18, 19 (see FIGS. 3 and 4) and is stopped there in a stable position. The link mechanism 24 can furthermore have a toothed or undulating surface, such that the movement sequence of the support plane 17 that is operatively connected to the link mechanism 24 is subjected to a vibrating movement. However, the traced surface can also be embodied that vibrations are transmitted to the support plane 17 during the tracing operation. In both cases, this has a positive effect on the position to be occupied by the book blocks, wherein this slanted stop position for the book blocks 61 can also be planned from the start as the normal position, so that no link mechanism or other auxiliary unit are needed for initiating this slanted position. In any case, such a slanted position has a stabilizing effect on the book block 61 mass, which is tied to an increase in its ability to persist. The compactness of the book block, ensured in this way, has a positive effect on the quality later on when the book block passes through the following processing stations.

In this connection, the slanted positioning of the takeover element 16 on purpose, caused by the effect of the link mechanism 24, can be replaced by using the above-mentioned strategy, meaning to keep the takeover element 16 in the position above the book channel 70 until the respective gripper finger 23 for picking up at this location has passed through the critical zone.

The change in the angle position of the book block can also be effected at a different optional location. In that case, a different mechanism would offer itself, e.g. via a motor shaft or a cam mechanism inside the rotor, which can be superimposed on the normal translation of the transfer device.

The configuration and rotary sequence of the transfer device according to the preceding FIGS. 3-6 are only intended as examples. It is possible without problems to use a transfer device according to the arrangement B shown in FIG. 7. This transfer device 30, which is operationally arranged downstream of and above the book block feed device 60 and the book channel 70, may be provided at the poles with a rotating rotor 31. A clamping device 32 that is effective in vertical downward direction is furthermore also arranged at these poles and grips respectively one book block 61 from the book block feed device 60 and moves it with the aid of a 90° angle movement into the plane for the book channel 70. The clamping effect is then released in this plane, such that the book block 61 can be conveyed via the book channel 70 to a different processing station 90. During the rotation, the clamping device 32 may execute a downward movement 33 in the direction of the book channel 70 to deposit the book block 61 carefully into the book channel 70, for which the rotary movement of the rotor 31 is connected to a linear component.

The processing station 90 is only indicated in FIG. 7. The transfer device 30 shown therein operates according to a different principle than the above-described transfer device 10 (FIGS. 3-6). We do not want to discuss in further detail herein the design options for such a clamping device 32. In addition, the rotational movement sequence of the transfer device 30 shown in FIG. 7 resembles that of a carousel, meaning a book block 61 is taken over at a specific point and the same book block 61 is transferred to the book channel 70, following a specific angular movement, such that it can be transported to a different processing station.

The clamping devices 32, located at the poles, can maintain the book block position with the aid of a planet gear, as previously described in connection with FIG. 1. However, it is also conceivable that during the 90° rotation—wherein this angle can also be different—the original book block position if necessary can be rotated further, for example by an additional angle of 90°, resulting in two connected rotary movements.

The advantages of this arrangement B must be seen in the fact that the number of effective clamping devices 32 as well as the angular speed can be varied without problems to take into consideration the given circumstances. In most cases, the operation may be based on a 90° timing rate, meaning a 90° rotary angle. However, a slanted-angle disposition of the transfer device 30 is also possible and, in particular, is recommended if the book blocks 61 must be supplied or must be conveyed further via a slanted plane. In all cases, the book block is transferred carefully, does not experience internal bending and retains the predetermined compactness or shape.

The linear translation of the clamping device 32 can be effective per se either toward the top or the bottom. The same is true for the clamping device shown in FIG. 8.

Figure 8:
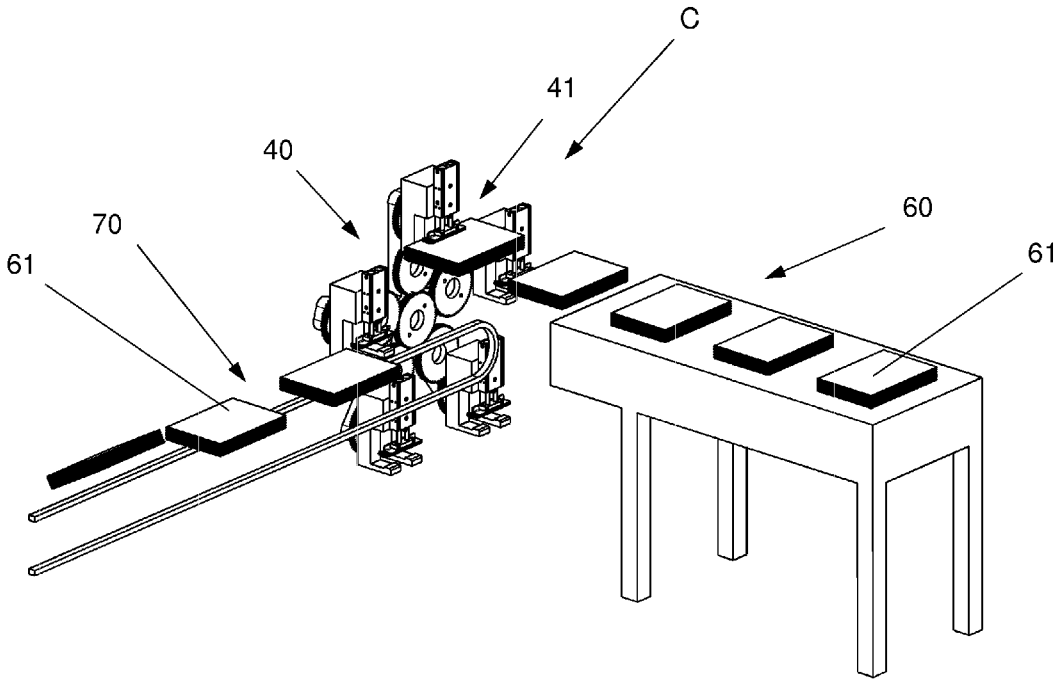
FIG. 8 depicts a different rotary-driven transfer device that rotates horizontally, relative to the book channel, and is provided with grippers, according to an embodiment of the invention.

FIG. 8 shows a different arrangement C, illustrating a different transfer device 40. The goal of this device is to configure the feeding of the book blocks 61 by the feed device 60 so that the book blocks can be supplied directly to a clamping device 41, wherein this clamping device 41 during the initial gripping of the book block 61 is located in a corresponding plane with a book block feed device 60, thus making it possible to directly supply the book blocks 61 to the transfer device 40. The transfer device 40 basically functions in a similar manner as the one shown for the arrangement A (see FIGS. 3-6), meaning once the supplied book block 61 is gripped by the clamping device 41, a rotary movement starts with the same technical features as already explained for the arrangement B (FIG. 7). However, the book blocks 61 in this case are transferred directly to the book channel 70 because the opening of the clamping device 41 is already sufficient to ensure a pickup and further transport of the book block 61. According to FIG. 8, the rotary movement of the transfer device 40 ensures that the book block 61 is transferred from a higher supply plane to a lower-positioned transport plane. Of course, a diametrically opposite configuration is also possible, in which the book block is transferred from a lower plane to a higher plane.

The arrangement C shown in FIG. 8 can also be configured such that the arms forming the clamping device 41 are in the lowest position when they are right above the book channel 70. Once the direction of rotation for the takeover element in clockwise direction is initiated, the book block can be deposited in movement direction of the gripper finger. The advantage of such a conforming movement sequence must be seen in that the speed of the book block relative to the gripper finger or to an end stop bar can be reduced to an optimum speed, such that the relative speed approaches zero and a secure, careful transfer of the book block is ensured.

FIG. 8 also shows the design variant where the transfer of the book block to the book channel 70 occurs not only at an angle of 90° relative to the transfer location, but where it is also possible without problem to transfer the book blocks at an angle of 180°, relative to the transfer location, meaning diametrically opposite thereto. That is to say, the book channel 70 in that case effectively operates while completely below the transfer device 40, which in turn allows it to operate with an optimized relative operating speed between the angular speed for the book block and the belt speed of the book channel. The conforming movement sequences between the rotational direction of the transfer device and the movement direction of the book channel were discussed in further detail in the previous paragraph.

Figure 9:
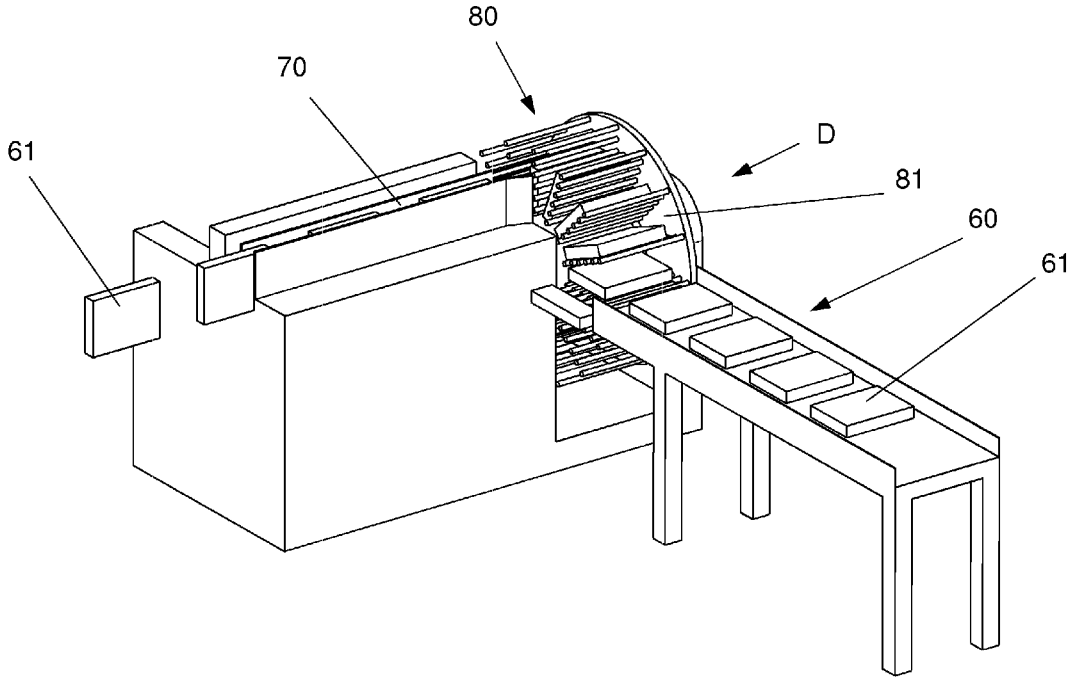
FIG. 9 depicts another transfer device, embodied as paddle-wheel type inlet star, according to an embodiment of the invention.

A different transfer device is shown in FIG. 9, wherein this variant is referred to as arrangement D. The transfer device 80 shown in this Figure consists of a bucket-wheel type intake star 80, which individually accepts the supplied book blocks 61 into the therefore provided intermediate spaces 81 and initially conveys these further in the same rotary plane as a result of the rotation. Upon completing an angle of rotation of approximately 90°, the book block 61 is then pushed out of the bucket-wheel type intake star 80 and is taken over by a book channel 70, arranged essentially at a right angle to the book block feed device 60, and is conveyed to the further processing location, wherein a different angle of rotation is also possible. The arrangement D is consequently configured such that the book blocks 61 are already positioned upright while inside the book channel 70, which is advantageous for the further processing since the book blocks 61 do not need to be repositioned to the upright position, for example inside a perfect binding station.

In connection with the above-described transfer devices, we also want to emphasize that these are particularly useful for providing maximum discharge cadences. As a result of the extraordinary compactness of these devices, it is possible to operate two or more transfer devices along the same book channel, which can accordingly be supplied with book blocks and fully utilized, wherein the discharge cadence for a following, jointly used book channel can also be increased multiple times.

With respect to the transfer devices discussed and shown in FIGS. 3-6, 7, 8 and 9, we must emphasize that the various embodiments on the whole have a congruent finality and are therefore subject matters that absolutely represent a uniform inventive idea.

Figure 10:
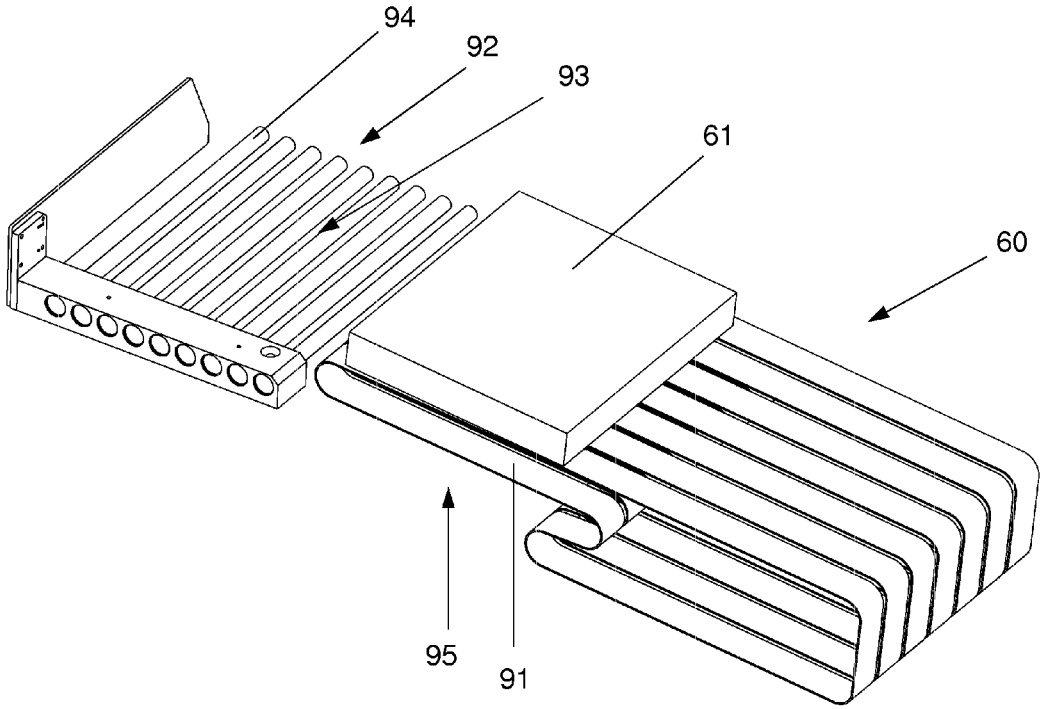
FIG. 10 depicts a conveying section between the book block feed device and the takeover element, wherein this section consists of a transport belt and a downstream arranged transfer plane and wherein the latter is roller-driven, according to an embodiment of the invention.

FIG. 10 shows a simplified representation of the area directly surrounding a book block feed device 60, downstream of a measuring/control station 50 (see FIG. 1), in which the removal of a book block 61 is triggered following the detection of a defect. The herein provided transfer-out location 95 in principle functions and can be activated in different ways. According to FIG. 10, this transfer-out location 95 is activated through a telescoping behavior of the conveying belt along the book block feed device 60, meaning that a section 91 of the conveying belt moves backward internally, thus exposing the area for the removal. For further details we point to FIGS. 11-13. Following the transfer-out location 95, the book block feed device 60 consists of a grid-type plane 92 which can be configured in different ways. The elements of the grid-type plane 92 may consist of driven, rotating rollers 94, positioned on one side and at a mutual distance 93 to each other, which are designed to result in a careful transport of the book blocks 61. It therefore makes sense to provide an adhering surface coating for the rollers 94 to ensure the friction between the rollers and the book blocks. With sufficiently high friction, the book block can be delayed just prior to reaching the end position at the takeover, so that it does not bounce back and/or spring back at the end stop 18 and such that the consistency of the book block is not lost. In principle, the rotation of the tubes [sic] 94 can thus also be configured individually, such that different vector forces act upon the book blocks 61, which can induce a deliberate change in direction during the transport.

Figure 11:
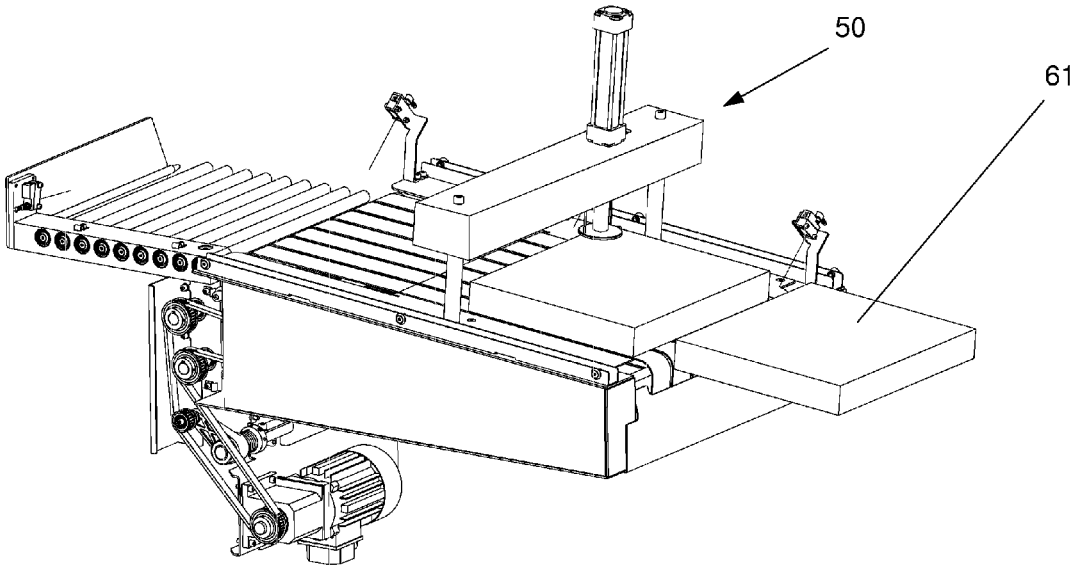
FIG. 11 depicts a detailed view of the measuring/control station that is arranged upstream of the transfer device in the book channel and comprises a transfer-out device, according to an embodiment of the invention.

FIG. 11 can be used to illustrate further advantages of the invention in connection with the transfer devices and the different configuration variants for the book channel described in the previous Figures. This FIG. 11 above all shows the feeding of the book blocks 61 to a transfer device, which is not shown in further detail herein. Prior to reaching this transfer device, the book blocks 61 pass through a measuring/control station 50 where different quality tests are carried out, in particular with respect to width, thickness, length etc. of the tested book block 61.

Figure 12:
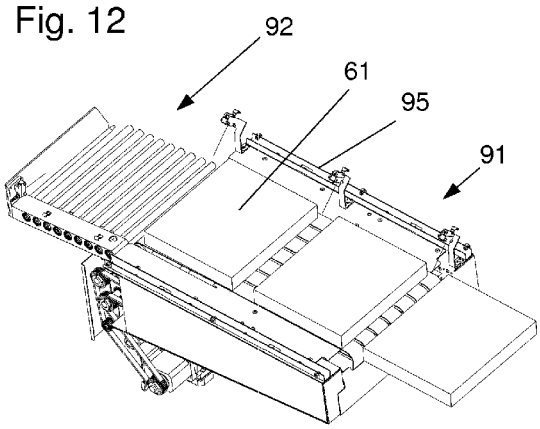
FIGS. 12-13 depict a mechanism showing the dynamic of a transfer-out operation, according to an embodiment of the invention.
Figure 13:
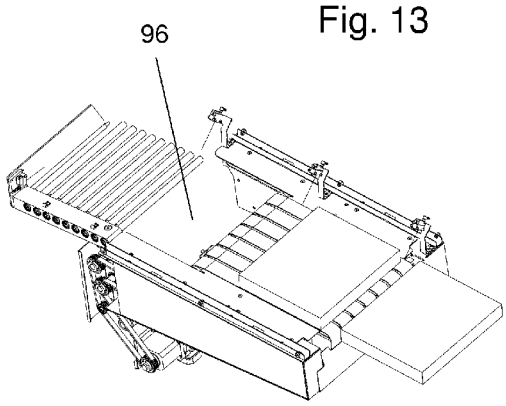

An identification of the book block 61 can also take place at this location, e.g. with the aid of a bar code/data matrix code/transponder/RF ID or the like. However, the identification can also take place downstream or upstream of the measuring/control station 50. If a book block 61 does not pass the quality control test, it is removed from the sequence, for example as shown in FIGS. 12 and 13, whereupon a gap is created in the book block flow. However, that is not really a problem because the transfer devices operating based on a rotary translation can maintain the predetermined throughput rate, which is not the case with a fixed design of a feed device.

Through adaptive accelerations or delays, which can be effective within the rotary movement of a transfer device as well as relative to the transport speeds within the book block feed devices 60 or the book channels 70, wherein these accelerations and delays in the speed follow a specific curve function, it is possible to smooth out interferences in connection with the transfer or the further conveying of the book blocks 61, as well as to influence the cadence during the transfer of the book blocks 61 to the following processing station. The curve function of one of the above-described transfer devices can furthermore be influenced without problem in one direction by using a linear feed device, not shown in further detail herein, especially if it is necessary to close a gap in the product flow, for example if there are numerous transfer-out operations triggered by the measuring/control station 50 or if the speed for the effective curve function is slowed down during the takeover or transfer-out of a book block.

With respect to this curve function, it must be mentioned here that the translation follows a movement profile composed of different adaptive curve functions and/or dwell times. One characteristic of the curve function according to the invention is that it can assume a uniform speed course if necessary. The discontinuities can be planned such that maintaining the originally intended cadence is ensured.

As previously explained with respect to FIG. 10, FIGS. 12 and 13 are intended to show the sequential steps for removing a book block 61 from the further processing, as indicated in FIG. 11. FIG. 12 in principle corresponds to the components according to FIG. 10. A transfer-out location 95, shown herein as a telescoping transport belt, is provided in front of the grid-type plane 92. With the aid of a special command issued by the measuring/control station 50 (see FIG. 11), the transfer-out location is activated and a defective book block 61 is removed from the further transport. The interruption in the original cadence, shown in FIG. 13, is designed to illustrate the interruption interval and is figuratively illustrated as the distance 96.

Figure 14:
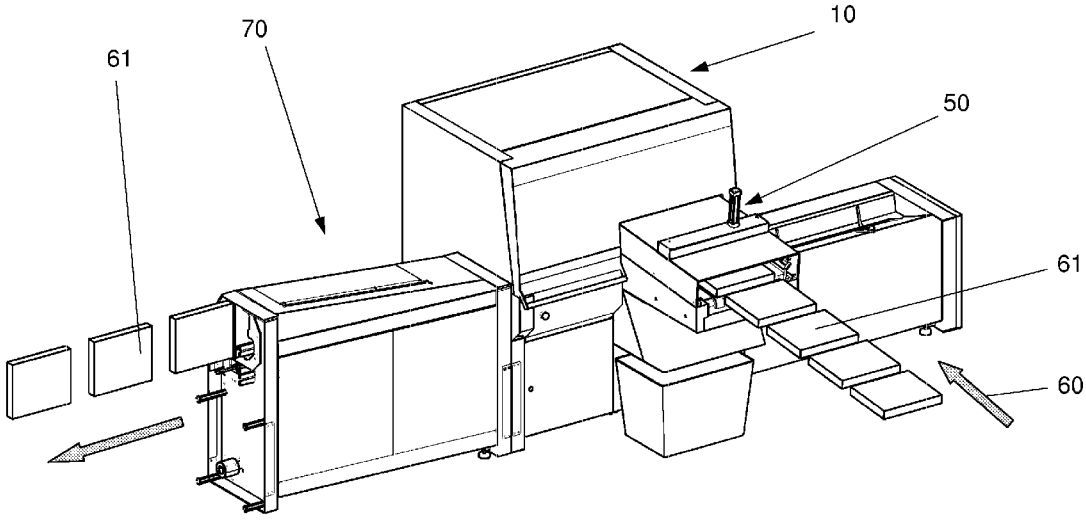
FIG. 14 depicts an easy to operate device for transferring book blocks to a processing station, wherein the transfer device is activated in this case, according to an embodiment of the invention.

FIG. 14 illustrates a simple feed device 60 for supplying the book blocks 61 to a transfer device 10. The processing station that is not shown in further detail herein normally contains book blocks 61 which are then supplied to further processing steps. As can be seen from this Figure, the book blocks 61 arriving from the book channel 70 already occupy a vertical, upright position, which coincides with the following processing operations. This Figure furthermore shows the installation of a measuring/control station 50.

The book block production machines can include a digital printing press and a stacking device for stacking the printed sheets, wherein a logistic system or a buffering system can furthermore be installed upstream of these components.

While several embodiments of the invention are described above, it should be understood that the foregoing is presented by way of example only, and not limitation. Thus, the breadth and scope of the invention should not be limited by the above-described embodiments, but should instead be defined only in accordance with the following claims and their equivalents.

The invention claimed is:

1. An arrangement for the timed processing of book blocks, composed of at least one printed sheet or at least one signature, wherein the arrangement comprises:

at least one book block feed device;

at least one processing station;

at least one transfer device, coupled to the at least one book block feed device to further convey the book blocks from the at least one transfer device to the at least one processing station, wherein the transfer device comprises at least one rotary or quasi-rotary translation device to take over the book blocks, wherein the at least one translation device operates in at least two dimensions to further convey the book blocks, wherein the at least one translation device has a uniform or changeable movement speed, and wherein the center axis of the at least one translation device occupies an optional position in space, relative to the at least one processing station; and a control station installed upstream of the at least one transfer device, wherein the control station measures at least the height, the width, and the thickness of a book block.

2. The arrangement according to claim 1, wherein the book blocks comprise printed sheets, and wherein the printed sheets are one of individual sheets or folded signatures.

3. The arrangement according to claim 1, wherein the book blocks comprise stacks of loose printed sheets or folded signatures, wherein the stacks are either stacked loosely one above other or are secured either temporarily or in-between the layers to keep them from slipping relative to each other.

4. The arrangement according to claim 1, wherein the at least one signature printed.

5. The arrangement according to claim 1, wherein the book blocks can immediately be conveyed directly or indirectly to the at least one book block feed device, which then supplies the book blocks to the at least one transfer device.

6. The arrangement according to claim 1, wherein the movement speed corresponds to a movement profile, wherein the movement profile comprises one or more curve functions that are separate or superimposed relative to each other, dwell times or standstill times.

7. The arrangement according to claim 1, wherein the movement speed of the at least one translation device and transport paths in connection with the book blocks can be changed adaptively.

8. The arrangement according to claim 1, wherein the center axis of the at least one translation device is positioned in space at a right angle, relative to the at least one processing station.

9. The arrangement according to claim 1, wherein the center axis of the at least one translation device occupies a perpendicular or quasi-perpendicular position in space, relative to the at least one book block feed device, and the at least one processing station.

10. The arrangement according to claim 1, wherein the center axis of the at least one translation device is positioned in space at an angle, relative to the at least one book block feed device, and the at least one processing station.

11. The arrangement according to claim 1, wherein the center axis is positioned in space to be fixed, movable, or dynamically changeable.

12. The arrangement according to claim 1, wherein the at least one processing station comprises a perfect binder, a casing machine, or an inserting machine.

13. The arrangement according to claim 1, further comprising a book channel having a forward movement, wherein with a concurrent movement direction for a rotational movement of the at least one transfer device and the forward movement of the book channel, the relative speed of both movements is approaching zero during the transfer of the book blocks from the at least one transfer device to the book channel.

14. The arrangement according to claim 1, further comprising a book channel having a forward movement and a takeover element having a support plane, wherein with opposite-directed movements for a rotational direction of the at least one transfer device and the forward movement direction of the book channel, the support plane first transfers the book block to an intermediate position above the book channel, wherein the book block is then accelerated along a descending path in the direction of the surface of the book channel, that in the end phase of this movement and with decreasing and adapted speed, the support plane assumes a quasi-asymptotic position relative to the book channel.

15. The arrangement according to claim 1, further comprising a takeover element having at least one support plane that forms a corner functioning as a stop wall for the book blocks at the lowest point of the takeover element when the takeover element is in a quasi-horizontal position.

16. The arrangement according to claim 1, wherein the at least one transfer device comprises one or more takeover elements, wherein the takeover elements rotate around a central point, and wherein the rotation can be generated with the aid of a planet gear.

17. The arrangement according to claim 1, further comprising a gripper finger or ejection element to transfer a book block to a book channel, wherein the rotational speed of the at least one transfer device and the linear cadence of the gripper finger or of the ejection element are position-dependent.

18. The arrangement according to claim 1, wherein the quasi-rotary translation movement of the at least one transfer device is composed of a rotary and a linear movement, effective in any optional direction in space.

19. The arrangement according to claim 18, wherein the linear movement is integrated before, in-between, or after the rotary translation of the at least one transfer device.

20. The arrangement according to claim 1, wherein identifying features can be read out in the larger area surrounding the control station, wherein these features are affixed to a book block in the form of bar codes or data matrix codes or transponder or RF ID.

21. The arrangement according to claim 1, wherein the control station is operatively connected to a downstream-arranged transfer-out location.

22. The arrangement according to claim 1, wherein the transfer device is a carousel-type rotor that essentially rotates parallel and is positioned above, relative to the book block feed device and a book channel.

23. The arrangement according to claim 22, wherein the carousel-type rotor (includes at least one clamping device that operates in vertical downward or vertical upward direction for the takeover and transfer of a book block.

24. The arrangement according to claim 1, wherein the rotary translation device is a bucket-wheel type intake star and wherein the intake star is provided with intermediate spaces for accommodating and transferring a book block.

25. The arrangement according to claim 1, wherein the at least one translation device includes a takeover element to convey the book blocks, wherein the takeover element carries out a rotary translational movement at least around the center axis.

26. An arrangement for the timed processing of book blocks, composed of at least one printed sheet or at least one signature, wherein the arrangement comprises:

at least one book block feed device;

at least one processing station; and at least one transfer device, coupled to the at least one book block feed device to further convey the book blocks from the at least one transfer device to the at least one processing station, wherein the transfer device comprises at least one rotary or quasi-rotary translation device to take over the book blocks, wherein the at least one translation device operates in at least two dimensions to further convey the book blocks, wherein the at least one translation device has a uniform or changeable movement speed, wherein the center axis of the at least one translation device occupies an optional position in space, relative to the at least one processing station, wherein the translation device includes at least one takeover element, wherein the at least one takeover element has at least one support plane including at least one stop wall that is operatively connected to the at least one support plane, and wherein the at least one takeover element carries out a rotary translation movement around an axis, executed in the horizontal position, relative to a planet-gear driven rotor.

27. The arrangement according to claim 26, further comprising a locally arranged link mechanism, wherein the at least one takeover element, during one phase of its rotary translation movement, is operatively connected to the locally arranged link mechanism, wherein the link mechanism is embodied such that the at least one takeover element is subjected to a simple or multi-axis inclination, and wherein the inclination induces at least one slanted-angle position for the at least one support plane of the at least one takeover element.

28. The arrangement according to claim 27, wherein the link mechanism acts upon the position of the takeover element and is arranged in the end phase of the rotary translation, relative to the book block, meaning just before the further transport of the book block to the following processing station.

29. The arrangement according to claim 27, wherein the link mechanism has an undulated surface or a toothed surface which, when it is traced, induces a jogging or vibrating movement of the at least one support plane to maximize a targeted position stabilization of the book block.

30. The arrangement according to claim 26, further comprising a gripper finger or a driving element to transfer a book block to a book channel in the end phase of the one cycle for the rotary translation of the at least one takeover element.

* * * * *